US008522882B2

(12) United States Patent
Rich

(10) Patent No.: US 8,522,882 B2
(45) Date of Patent: Sep. 3, 2013

(54) APPARATUS AND METHOD FOR PUMPING WELL FLUIDS AND DEBRIS

(76) Inventor: Jerry Rich, Bakersfield, CA (US)

( * ) Notice: Subject to any disclaimer, the term of this patent is extended or adjusted under 35 U.S.C. 154(b) by 191 days.

(21) Appl. No.: 13/029,693

(22) Filed: Feb. 17, 2011

(65) Prior Publication Data

US 2012/0211237 A1 Aug. 23, 2012

(51) Int. Cl.
*E21B 43/00* (2006.01)

(52) U.S. Cl.
USPC ..... 166/369; 166/105.2

(58) Field of Classification Search
USPC ..... 166/369, 105, 105.2, 68
See application file for complete search history.

(56) References Cited

U.S. PATENT DOCUMENTS

| | | | | |
|---|---|---|---|---|
| 1,178,217 | A * | 4/1916 | Conrader | 92/182 |
| 2,834,300 | A * | 5/1958 | Brock | 166/99 |
| 5,505,258 | A | 4/1996 | Muth | |
| 5,765,639 | A | 6/1998 | Muth | |
| 5,934,372 | A | 8/1999 | Muth | |
| 6,145,590 | A * | 11/2000 | Havard | 166/105.2 |
| 6,250,392 | B1 | 6/2001 | Muth | |
| 6,273,690 | B1 | 8/2001 | Fischer et al. | |
| 6,543,543 | B2 | 4/2003 | Muth | |
| 6,830,441 | B1 | 12/2004 | Williams | |
| 7,008,197 | B2 * | 3/2006 | Ford | 417/430 |
| 7,686,598 | B2 | 3/2010 | Williams | |
| 2002/0066572 | A1 * | 6/2002 | Muth | 166/369 |
| 2008/0112826 | A1 * | 5/2008 | Ford | 417/430 |
| 2012/0141310 | A1 | 6/2012 | Conyers et al. | |

OTHER PUBLICATIONS

Harbison-Fischer Product Information Letter, Nov. 5, 2010.*
Documents Received in an anonymous email to the Applicant on Dec. 21, 2011 and attached hereto.
Documents received via email to the Applicant on May 1, 2012 and attached hereto. No date or other confirmation of the disclosed device could be found.

* cited by examiner

*Primary Examiner* — David Andrews
*Assistant Examiner* — Marwan Bashir
(74) *Attorney, Agent, or Firm* — Jeffrey A. Travis; Borton Petrini, LLP

(57) ABSTRACT

A pump system and method comprising a pump barrel adapted for use within a well. A reciprocating plunger disposed within the pump barrel and operatively engaging a connector between the plunger and a pumping unit. The connector operatively engages the pumping unit and further comprises an inner and outer portion with a groove between the inner and outer portions; one or more ports disposed between the inner and outer portions and accessing an inner cavity of the connector; and the inner portion further comprising one or more ports accessing the inner cavity of the connector. The pump system and method further comprising a cage valve to create hydraulic pressure to expel trapped debris.

6 Claims, 9 Drawing Sheets

APPARATUS AND METHOD FOR PUMPING WELL FLUIDS AND DEBRIS

CROSS REFERENCE TO RELATED APPLICATIONS

Not Applicable.

FEDERALLY SPONSORED RESEARCH

Not Applicable

SEQUENCE LISTING OR PROGRAM

Not Applicable.

BACKGROUND OF THE INVENTION

1. Field of the Invention

The invention and its various embodiments disclosed herein relate to a pump system for extracting well fluids from below the ground. More particularly, the invention relates to devices and methods for extracting well fluids and directing debris away from the barrel or casing of a well.

2. Description of Related Prior Art

Conventional pumping systems for extracting oil from the ground include an above-ground pumping unit and a down-hole pumping system. The down-hole pumping system typically includes a barrel and casing that lines the hole. Disposed inside the barrel are inserted a rod ("sucker rod") that couple to standard American Petroleum Institute ("API") plungers and plunger connectors. The action of a plunger driven by a sucker rod creates suction based on the system's up and down strokes. Suction is created by the plunger having an annular lumen with an internal valve at the bottom of a plunger that closes on upstroke and then opens on down stroke allowing well fluids to enter the bottom of a plunger and out through an opening at the top of a plunger and through one or more ports on the connector. Typical well pump systems can also include a barrel evacuating chamber between a lower valve on a plunger and a valve at the bottom of the pump system where fluids flow from the fluid deposit into the evacuation chamber and through the plunger depending on the pump stroke.

Problems with traditional plungers have been that along with well fluids being pumped through the pump system, this includes debris such as sand and other fines that get forced up and out of the plunger and which then settle between the plunger and the barrel causing the side of the plunger to become grooved, lose functionality and performance. If enough debris becomes lodged between the plunger and the barrel, the pump can lock into place. This has largely been caused by the slope of the top of the plunger which in a standard API plunger connector slopes downward from a central axis of the connector to the barrel wall wherein debris is pushed toward the side of the plunger and barrel when the debris settles.

The problem of debris clogging plungers has been previously addressed by Muth. (See, e.g., U.S. Pat. No. 6,250,392, FIG. 12) Muth attempted to overcome the above-described problem by disposing the plunger connector internal to the lumen of the plunger and creating an open-top plunger design. Additionally, Muth created a tapered edge which would direct debris into the interior of the plunger such that the plunger would act to trap debris which could then be expelled on the down stroke. Therefore, currently, those in the field are faced with the choice of using a Muth plunger or, using a standard API plunger and the problems that come with it.

A further attempt to prevent debris from becoming trapped between a barrel and plunger was described by Havard, U.S. Pat. No. 6,145,590, which attempted to prevent debris through the use of a flexible annular ring around a plunger connector.

What is needed is a device that can incorporate the benefits of preventing debris from becoming trapped between a plunger and the hole barrel yet also utilizes standard plunger technology. Further, what is also needed is a method for using hydraulic pressure through an extra valve internal to the connector to expel debris upwards and away from the plunger to production tubing.

SUMMARY OF THE INVENTION

The present invention provides a pump system for producing well fluids and directing debris from pumped fluids away from a plunger comprising a pump barrel adapted for use within a well with means for connecting to a reciprocating plunger disposed within the pump barrel and operatively engaging a connector. To actuate the pump system a connector operatively engages a pumping unit. The connector further comprises an inner and outer portion wherein the inner portion typically comprises a diameter smaller than the outer portion; the outer portion further comprises a tapered edge that forms a groove between the inner and outer portions allowing debris to settle into and be forced out through one or more ports disposed between the inner and outer portions of the connector and which access an inner cavity of the connector. The inner portion further comprises one or more ports accessing the inner cavity of the connector which is generally an axial lumen internal to the connector and extending from a connection to a plunger and allowing fluid to flow from a plunger through fluid ports on the connector to production tubing.

The pump system further includes an inner portion disposed primarily above the outer portion; wherein the outer and inner portions are generally tubular in shape; and the groove extends around the circumference of the inner portion allowing debris to be directed from the outer perimeter of the connector toward the inner cavity of the connector.

The pump system may also include a cage valve disposed between the inner portion and the plunger wherein the valve open and closes access to a plunger and an upper portion of the inner portion on up and down strokes.

The present invention also provides a method for creating a pump system through adapting a pump system for pumping well fluids from underground wherein the pumping system comprises a barrel, a reciprocating plunger disposed within the pump barrel and which operatively engages a connector, the connector operatively engages a pumping unit, and wherein the connector further comprises an inner and outer portion with a groove between the inner and outer portions; one or more ports disposed between the inner and outer portions and accessing an inner cavity of the connector; the inner portion further comprising one or more ports accessing the inner cavity of the connector; and actuating the pump system wherein the plunger and connector are reciprocated though up strokes and down strokes whereby well fluids are forced through the one or more ports between the inner and outer portion and the one or more ports on the inner portion on down strokes, and wherein debris is directed downward and into the inner cavity on up strokes.

In another exemplary embodiment, the method further includes an inner portion disposed primarily above the outer portion; the outer and inner portions are generally tubular in shape; and the groove is annular.

In another exemplary embodiment of the method, the connector further comprises a cage valve disposed between the inner portion and the plunger and wherein the ball of the cage valve is larger than an internal opening into the inner portion; and the ball of the cage valve is larger than an opening in the top of the plunger.

DETAILED DESCRIPTION OF THE DRAWINGS AND PREFERRED EMBODIMENTS

A complete understanding of this invention can be gained through reference to the drawings in conjunction with a thorough review of the disclosure herein.

Figures 1, 2, 3, 4:
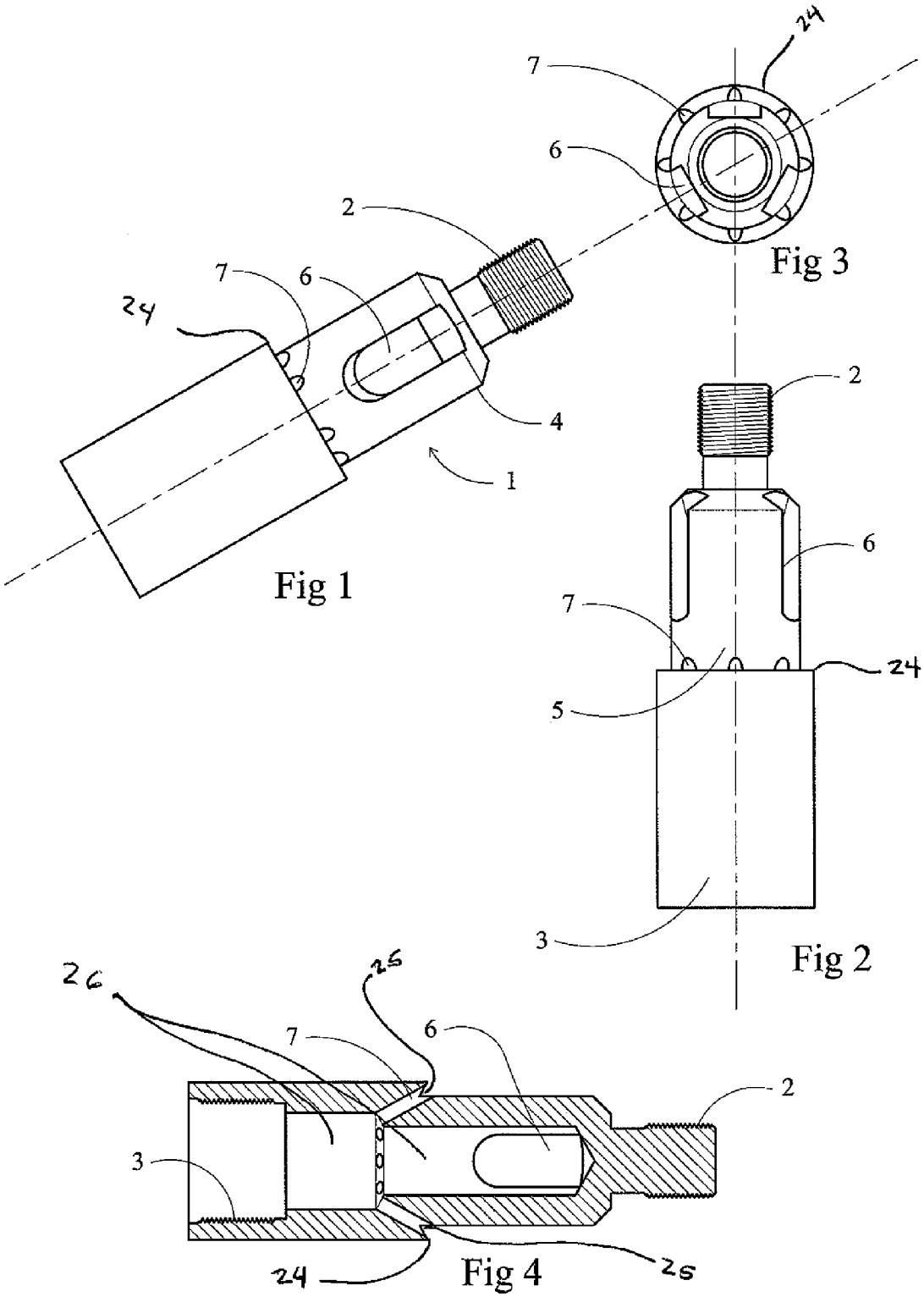
FIG. 1 is a view of the power thruster plunger rod connector showing relational lines to sectional view in FIG. 3.
FIG. 2 is a view of the power thruster plunger rod connector showing relational lines to sectional view in FIG. 3.
FIG. 3 is a sectional view of a connector having a groove and ports.
FIG. 4 is a side sectional view of a connector without a cage valve.
Figure 5:
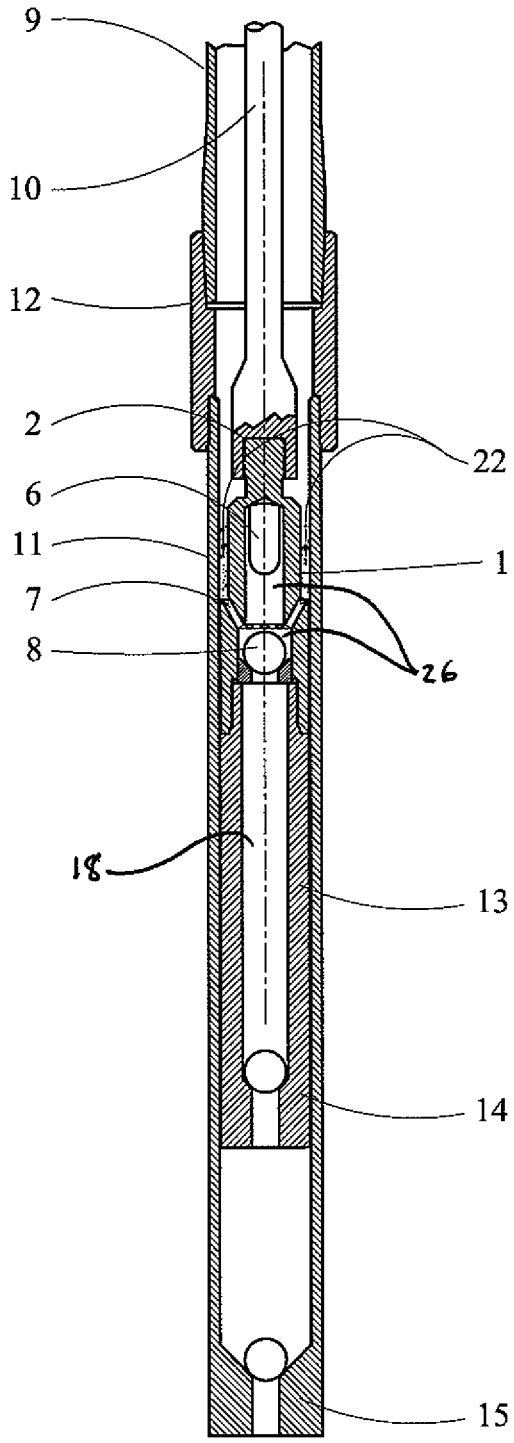
FIG. 5 is a partial, vertical sectional view of a pumping system using a connector with a cage valve.

A standard pump system includes an above-ground pump unit (not disclosed, but see, e.g., U.S. Pat. No. 5,505,258, FIG. 1, reference nos. 23 and 11) that actuates a below-ground (down-hole) pump system. A standard down-hole pump system (as illustrated in FIG. 5) typically includes a hole casing or barrel 11 and barrel coupling 12. Disposed internally to the barrel is a pumping unit comprised of a sucker-rod 10 threadably connected to a connector which, in turn, is threadably connected to a plunger 13. Internal to the plunger 13 is an axial lumen or cavity 18 with a central opening at the top and through which well fluids and debris (e.g., nos. 17, 19, and 22 in FIG. 5*b*) flow on up stroke and down stroke.

To lift fluids in a standard pump system, plungers house a traveling valve 14 wherein the ball of the valve is seated and supports fluid load. On down stroke, (FIG. 5*b*) the ball is un-seated, allowing fluids to travel up through the plunger, out through fluid ports in a standard API plunger connector, and into production tubing or columns, the opposite occurs on up stroke. (FIG. 5*a*) During the same actions, on up stroke a standing ball valve 15 is disposed at the lower end of an evacuating barrel 26 and which allows fluid to enter the evacuating barrel 26 between the plunger and the valve 15. On down stroke, the valve 15 closes. Included in well fluids being pumped are fines and other debris 21 and 22 that are lifted and expelled through production tubing and settle in and around the top and sides of a plunger 13 and standard plunger API plunger connectors. These fines and debris collect between barrel 11 and plunger 13, oftentimes damaging plungers and halting production when too much debris settles and collects.

In a first embodiment, the invention avoids the problem of debris clogging pump systems found in the prior art through the novel use of a connector 1 (FIG. 1) that is adapted to fit over a standard API plunger. Of course, the preferred embodiments show a connector 1 being threadably connected to plunger 13 however, any preferred and available means for connecting to a plunger can be used. Connector 1 incorporates a tapered edge 24 created by an annular groove 25 between an axial portion 4 of connector 1 and barrel 11. Disposed between the edge 24 and the axial portion 4 of the connector 1 are one or more ports 7 that act to receive and expel debris (See, e.g., FIGS. 5*a* and 5*b*, reference no. 22) on up and down stroke of a pump. Additionally, one or more upper fluid bypass ports 6 are also disposed on a central axial portion of connector 1. Each of ports 6, 7 access a central cavity portion 26 of connector 1. The central cavity 26 is disposed along the internal axis of the connector and which allows fluid to flow through plunger 13 through connector 1 and out through ports 6 7 into production tubing.

Figure 5A:
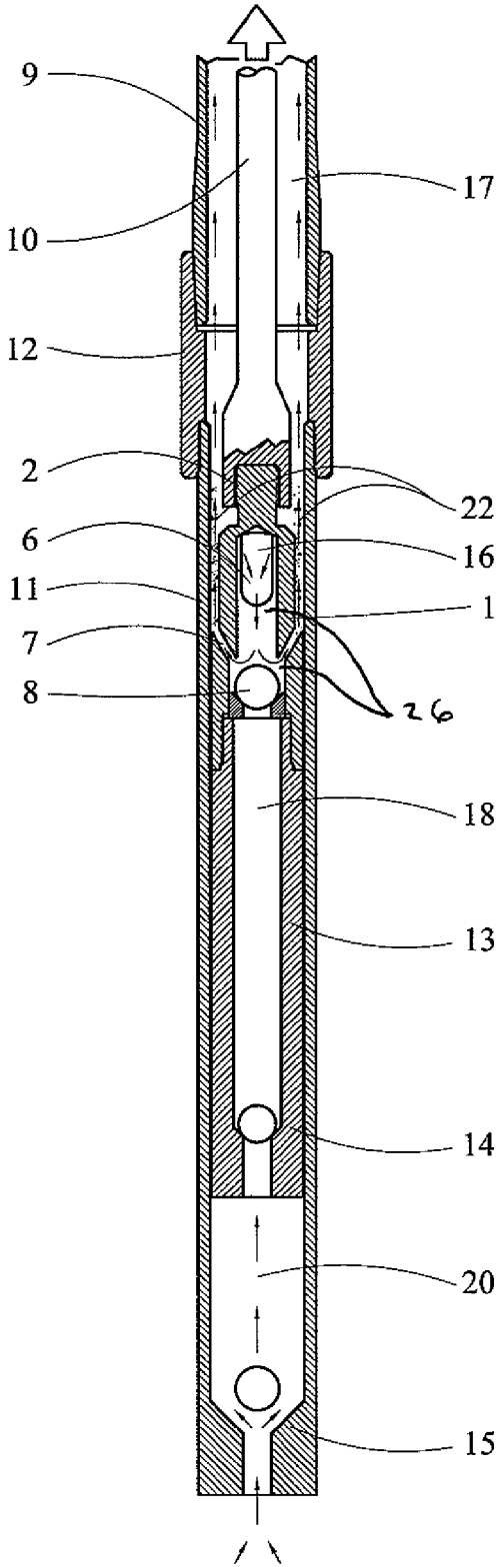
FIG. 5*a* is a partial, vertical sectional view of a pumping system using a power thruster with a cage valve during action on an up stroke of the pumping system.
Figure 5B:
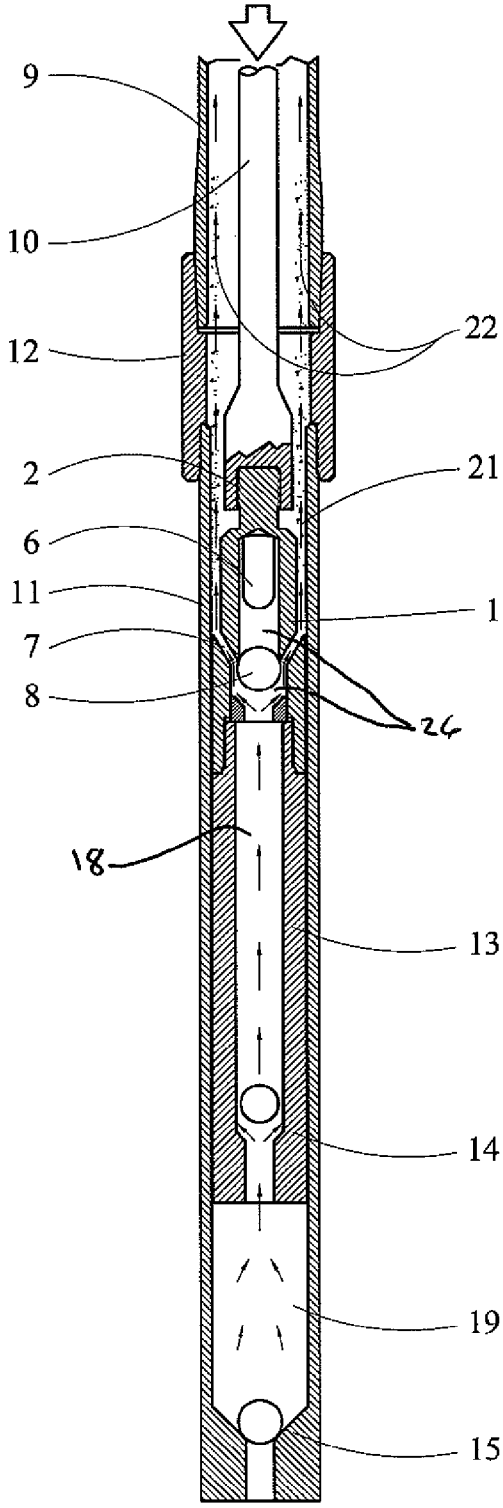
FIG. 5*b* is a partial, vertical sectional view of a pumping system using a power thruster with a cage valve during action on a down stroke of the pumping system.
Figure 5C:
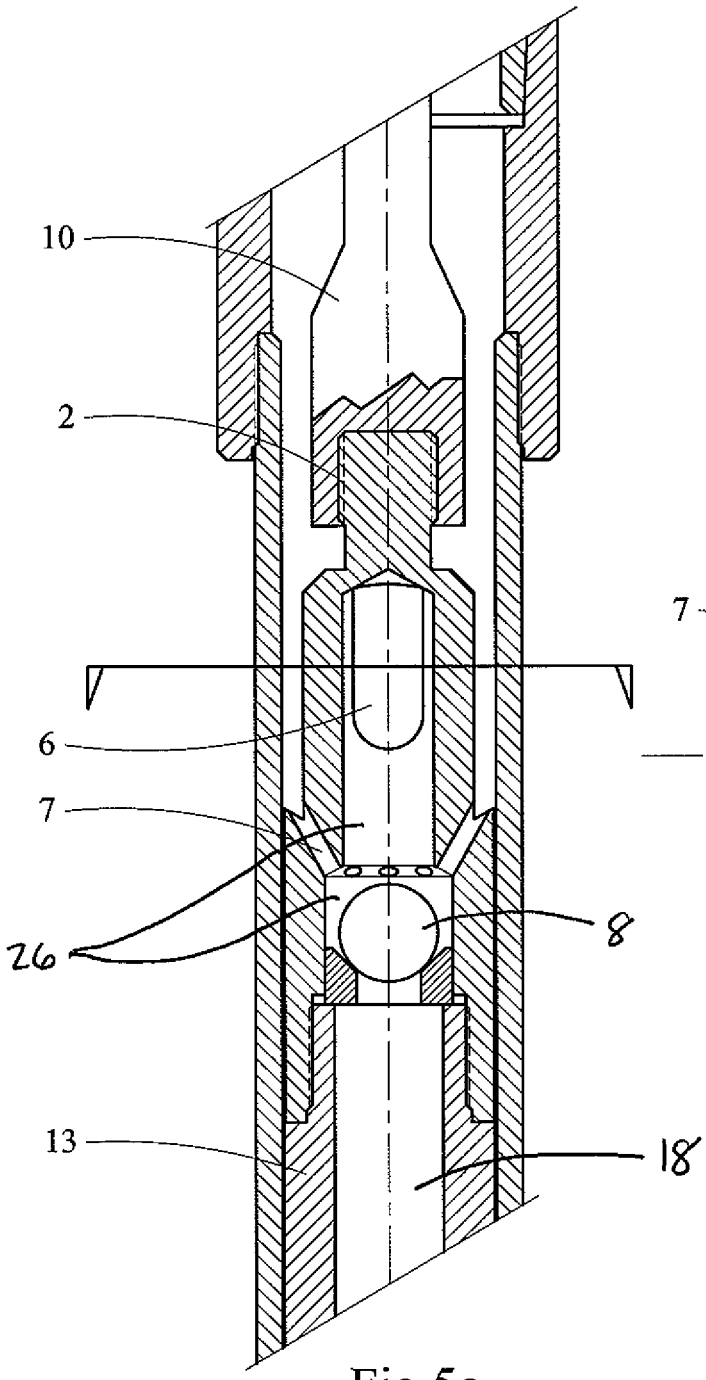
FIG. 5*c* is a partial, vertical sectional view of a power thruster with a cage valve.
Figure 5D:
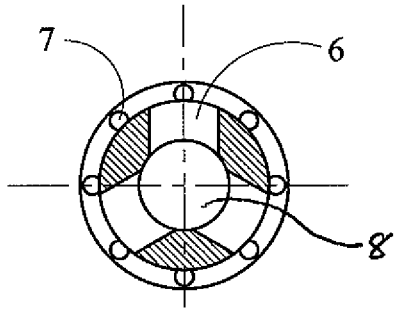
FIG. 5*d* is a sectional view at A-A of FIG. 5*c*.
Figure 6:
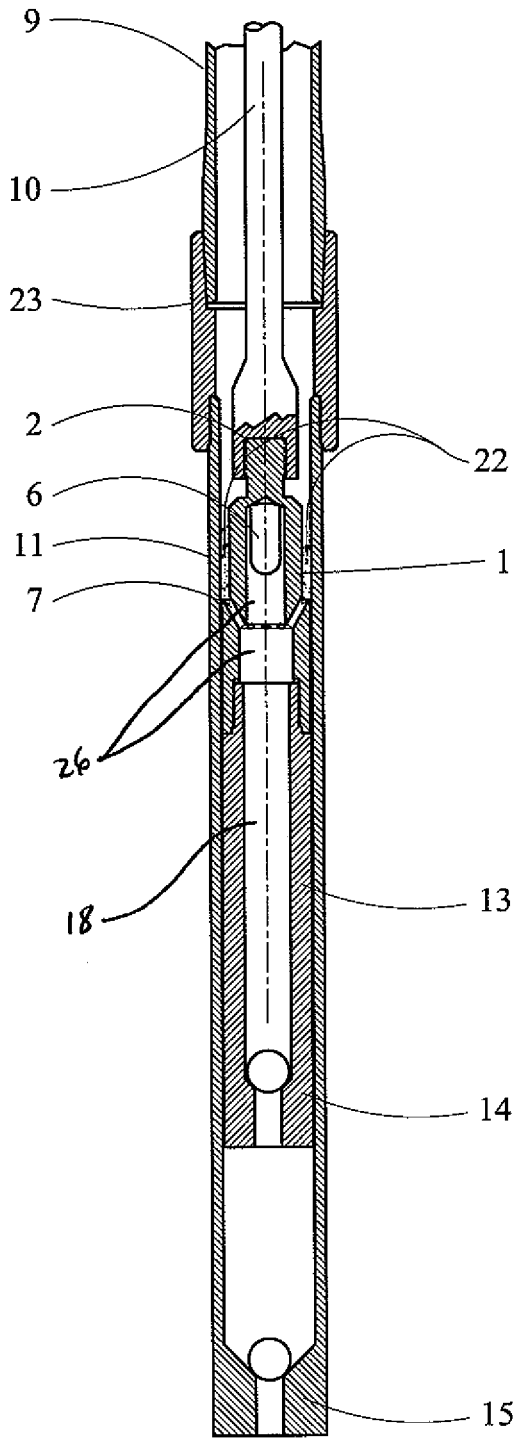
FIG. 6 is a partial, vertical sectional view of a pumping system using a power thruster without a cage valve.
Figure 6A:
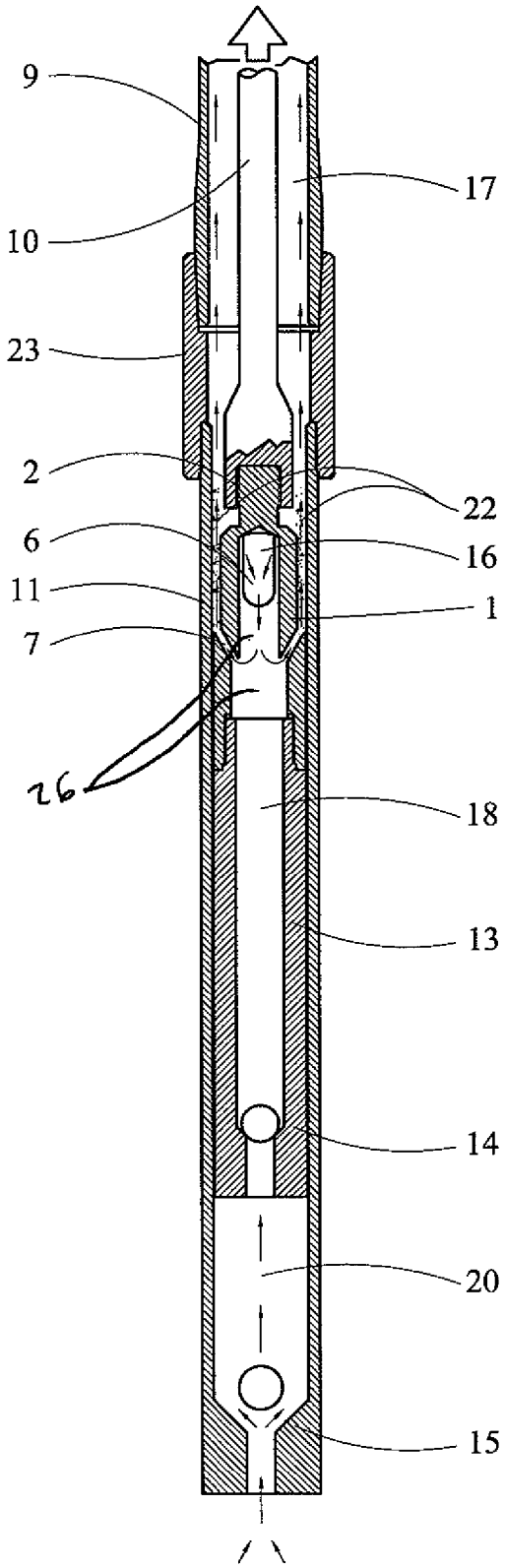
FIG. 6*a* is a partial, vertical sectional view of a pumping system using a power thruster without a cage valve during action on an up stroke of the pumping system.
Figure 6B:
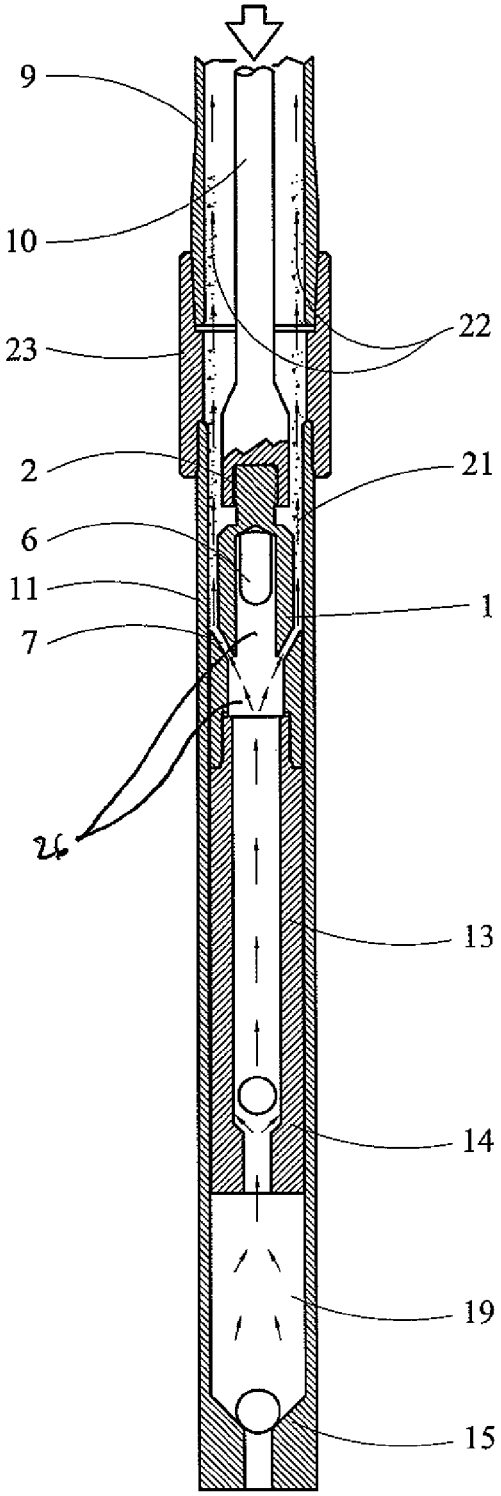
FIG. 6*b* is a partial, vertical sectional view of a pumping system using a power thruster without a cage valve during action on a down stroke of the pumping system.
Figure 6C:
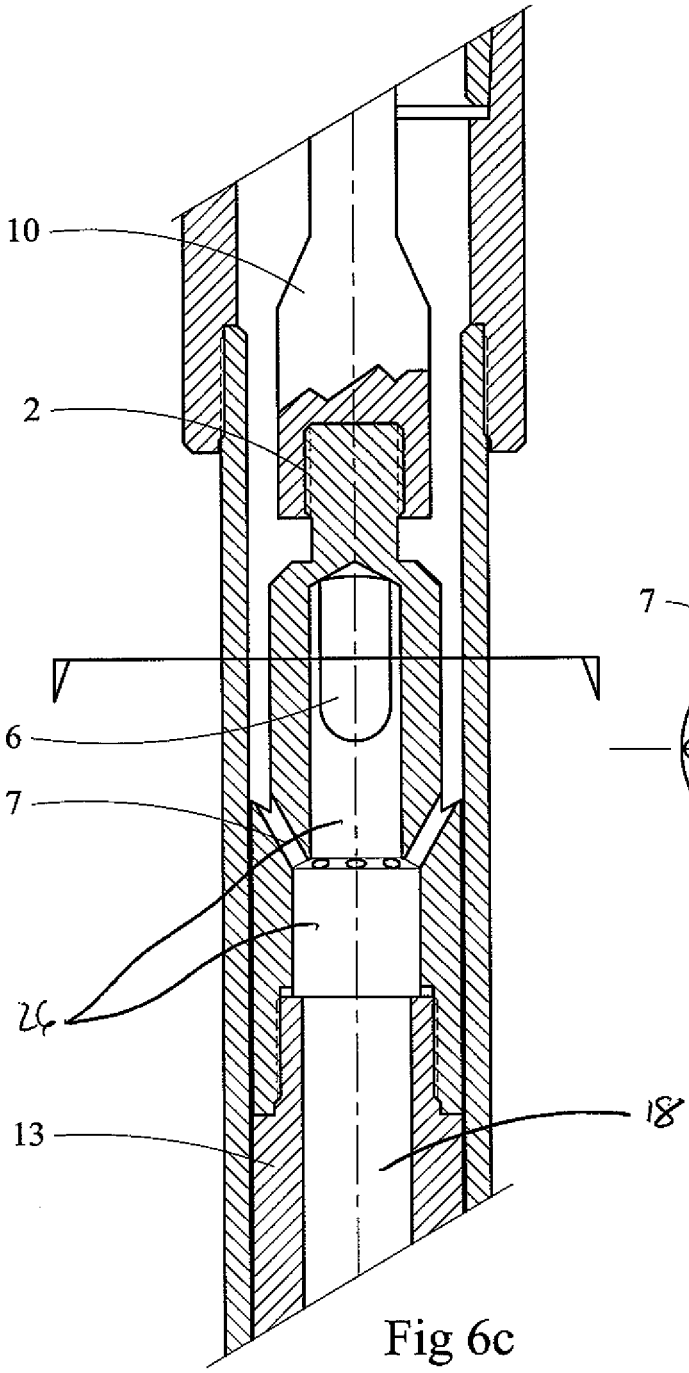
FIG. 6*c* is a partial, vertical sectional view of a power thruster without a cage valve.
Figure 6D:
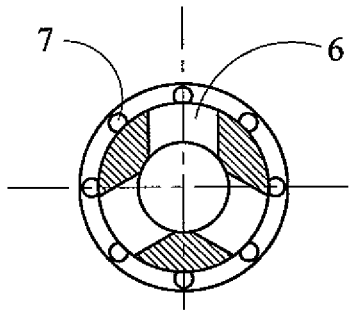
FIG. 6*d* is a sectional view at A-A of FIG. 6*c*.

To accommodate a cage valve 8, (See FIG. 5) internal cavity 26 narrows above ports 7 forming a smaller upper cavity and allowing a ball of valve 8 to close access of fluids into an upper portion of cavity 26. Cage valve 8 is contained between a smaller internal perimeter of an upper cavity portion and a smaller opening in plunger 13. On up stroke cage valve 8 closes access of fluids between plunger 13 and internal cavity 26 of connector 1 as shown in FIG. 5*a* and debris settles into cavity 26 through ports 6 as shown by directional arrows 16. Hydraulic pressure is created by closing of cage valve 8 such that when down stroke occurs and pressure is released (FIG. 5*b*) fluid and debris are forced through ports 7, in which any debris will be forced out from connector 1.

Although the figures illustrate a cage valve, those skilled in the art will appreciate that other valves may be used to accommodate the purpose of this embodiment of the invention.

Further, the above-described embodiment discloses a cylindrical or generally tubular upper and lower axial cavity of connector 1 although those skilled in the art will appreciate that the invention can include other dimensions and internal cavities to effectuate the purpose of the various embodiments disclosed herein.

Further, connector 1 can be further strengthened through the use of boronizing or other metal treating techniques. The Rockwell hardness range of a typical spray metal plunger is between 57-62 HRC. Although standard hardness will work, the invention is preferred to be between 75-80 HRC.

Alternatively, another embodiment of the invention can be converted to allow larger debris to be pumped by taking out ball of cage valve 8 and utilizing connector 1 for use with a plunger 13. Removing cage valve 8 will allow debris to also pumped out through fluid ports 6 in addition to ports 7. This method is preferred for thicker oil.

In the preferred embodiment, the upper portion of the connector 4 is disposed primarily above the lower portion of the connector 3. However, although preferred, other variations including disposing the upper portion further down into the connector are also possible and would be possible to effectuate the purposes of the invention if the internal cavity or overall size of the connector were increased.

While the above description contains various preferred, exemplary, and other specific embodiments, these should not be construed as limitations on the scope of the invention, but as exemplifications of the presently preferred embodiments thereof. Many other ramifications and variations are possible within the teaching of the invention. Thus the scope of the invention should be determined by the appended claims and their legal equivalents, and not solely by the examples given.

I claim:

1. A pump system comprising:

a pump barrel for use within a well;

a reciprocating plunger disposed within the pump barrel and operatively engaging a removable connector adapted to flushly secure over the top of the plunger;

said connector operatively engaging a pumping unit;

the connector further comprising: an inner and outer portion with an upwardly disposed tapered edge between the inner and outer portions; and one or more tubular ports extending generally diagonally from the axis of the connector and adapted to expel fluids through hydraulic pressure resulting from the reciprocating action of the plunger and wherein said ports are annularly disposed between the upwardly disposed tapered edge and the inner portion and accessing an inner cavity of the connector;

the connector further comprising an axial bore adapted to allow fluids to pass through the connector; and the connector further comprising one more upper fluid bypass ports disposed on the inner portion.

2. The pump system of claim 1 wherein the inner portion is disposed primarily above the outer portion; the outer and inner portions are generally tubular in shape; and the upwardly disposed tapered edge is annular.

3. The pump system of claim 1 wherein the connector further comprises an internal ball cage valve.

4. A method for creating a pump system comprising:

adapting a pump system for pumping well fluids from underground wherein said pump system comprises: a barrel, a reciprocating plunger disposed with the pump barrel and operatively engaging a removable connector adapted to flushly secure over the top of the plunger, the connector operatively engaging a pumping unit, and wherein the connector further comprises an inner and an outer portion with an upwardly disposed tapered edge between the inner and outer portions; one or more tubular ports extending generally diagonally from the axis of the connector and adapted to expel fluids through hydraulic pressure resulting from the reciprocating action of the plunger and wherein said ports are annularly disposed between the upwardly disposed tapered edge and the inner portion and accessing an inner cavity of the connector; the connector further comprising an axial bore adapted to allow fluids to pass through the connector and one more fluid bypass ports disposed on the inner portion; and actuating the pump system through up strokes and down strokes whereby well fluids are forced through the one or more ports between the inner and outer portion and the one or more fluid bypass ports on the inner portion on down strokes, and wherein debris is directed downward and into the inner cavity on up strokes by the upwardly disposed tapered edge.

5. The method of claim 4 wherein the inner portion is disposed primarily above the outer portion; the outer and inner portions are generally tubular in shape; and the upwardly disposed tapered edge is annular.

6. The method of claim 4 wherein the connector further comprises an internal ball cage valve.

* * * * *